US007331886B2

(12) United States Patent
Morris et al.

(10) Patent No.: US 7,331,886 B2
(45) Date of Patent: Feb. 19, 2008

(54) SLIDING ARROW STABILIZER

(75) Inventors: Paul Morris, Tucson, AZ (US); Larry Peterson, Patagonia, AZ (US)

(73) Assignee: Desert Dynamic Research, Inc., Tucson, AZ (US)

( * ) Notice: Subject to any disclaimer, the term of this patent is extended or adjusted under 35 U.S.C. 154(b) by 569 days.

(21) Appl. No.: 10/227,002

(22) Filed: Aug. 23, 2002

(65) Prior Publication Data

US 2003/0045381 A1 Mar. 6, 2003

Related U.S. Application Data

(60) Provisional application No. 60/315,165, filed on Aug. 28, 2001.

(51) Int. Cl.
*F42B 6/04* (2006.01)

(52) U.S. Cl. ..... 473/578

(58) Field of Classification Search ..... 473/578, 473/582, 583, 585, 586; 416/195
See application file for complete search history.

(56) References Cited

U.S. PATENT DOCUMENTS

| | | | | |
|---|---|---|---|---|
| 1,424,672 | A * | 8/1922 | Ogrissek | 416/193 R |
| 3,746,334 | A | 7/1973 | Stubblefield | 272/59 |
| 3,815,916 | A | 6/1974 | Meszaros | 273/106.5 |
| 3,903,639 | A * | 9/1975 | Howell | 446/57 |
| 3,946,519 | A | 3/1976 | Vadik et al. | 46/79 |
| 4,182,513 | A | 1/1980 | Henderson | 273/106.5 C |
| 4,204,307 | A | 5/1980 | Pfetzing | 29/407 |
| 4,589,778 | A * | 5/1986 | Mitchell | 366/316 |
| 4,905,397 | A | 3/1990 | Juelg, Jr. | 43/6 |
| 5,234,220 | A * | 8/1993 | Schellhammer et al. | 473/578 |
| 5,311,855 | A | 5/1994 | Basik | 124/44.5 |
| 5,439,231 | A | 8/1995 | Roberts et al. | 273/423 |
| 5,496,041 | A | 3/1996 | Broussard | 273/416 |
| 5,846,147 | A | 12/1998 | Basik | 473/586 |
| 5,863,250 | A * | 1/1999 | Harris | 463/34 |
| 5,951,419 | A | 9/1999 | Cameneti | 473/586 |
| 6,179,736 | B1 | 1/2001 | Thurber | 473/578 |
| 6,454,623 | B1 | 9/2002 | Flatau | 446/34 |
| 6,695,727 | B1 | 2/2004 | Kuhn | 473/586 |

FOREIGN PATENT DOCUMENTS

| | | |
|---|---|---|
| GB | 498823 | 1/1939 |
| GB | 620536 | 3/1949 |

* cited by examiner

*Primary Examiner*—John A. Ricci
(74) *Attorney, Agent, or Firm*—Hayes Soloway P.C

(57) ABSTRACT

An improved arrow and sliding stabilizer therefor are provided. The sliding stabilizer is used for stabilizing arrow flight, instead of fixed or glued tail feathers, vanes or other fletching. The invention improves current projectile technology with reduced assembly labor cost, the elimination of bow clearance issues, improved accuracy with the consistent production of the sliding stabilizer, easy replacement of the stabilizer in the field, and improved arrow storage. A sliding stabilizer is designed to slide along the shaft of an arrow and comprises an annular wing and a plurality of fins. In use, the stabilizer is positioned at the front of the arrow prior to launch, and the arrow slides quickly through the stabilizer until secured at a stop position at or near the trailing end of the arrow.

42 Claims, 4 Drawing Sheets

SLIDING ARROW STABILIZER

CROSS REFERENCE TO RELATED APPLICATION

This application claims the benefit of U.S. Provisional Patent Application No. 60/315,165, filed on Aug. 28, 2001, the teachings of which are incorporated herein by reference.

BACKGROUND OF THE INVENTION

1. Field of the Invention

This invention relates generally to a stabilizer for a projectile, and more particularly, to a stabilizer for the flight of an arrow in the field of archery.

2. Definitions

"Fletching" is a generic term used to describe the fins of an arrow that guide and stabilize the arrow during flight. These fins, when made from natural feathers, are commonly referred to collectively as "fletching", comprising individual "fletches." When made from plastic or other man-made materials, these fins are called "vanes." In the present application, the terms "fletching," "feathers," "vanes," and "fins" are employed throughout when describing fins of any type and are used interchangeably.

"Nock" is a generic term used to describe the portion of the arrow that secures the arrow in place before launch, typically by surrounding the bowstring with a notched area.

"Stop" is a term that may be used herein for a device for securing a stabilizer consistent with the present invention onto an arrow or a component thereof.

"Arrow rest" is typically the term for a small protrusion or device on the bow at the point where the arrow will rest during the draw, to hold the arrow away from and reduce contact with the riser (the thick, non-bending center portion of the bow).

A "fall-away" rest is an arrow rest that holds the arrow with an element that "falls away," drops, or otherwise travels away from the arrow when the string is released, thereby reducing or eliminating contact between the arrow rest and portions of the arrow itself, e.g., shaft or fletching.

3. Description of Related Art

Arrows typically are fletched on the rear of an arrow shaft to provide flight stability. Usually, three or four fletches are mounted in a circumferentially spaced relationship. The practice of using multiple pieces or individual fletches has remained virtually unchanged over time, wherein each fletch or vane must be glued in place separately, either by hand, or with the aid of a tool or fletching jig. This process is time consuming and introduces inconsistencies in spacing and angles. Minute inconsistencies in the form of unevenly spaced fletching, varying distances from the end of the arrow shaft, and angular variations have a profound effect on the flight of an arrow.

Moreover, polluting and toxic chemicals are often required to clean the arrow shaft prior to gluing.

Further, conventionally fletched arrows are easily damaged in the field or while in storage. When damaged, conventional fletching is normally not considered field replaceable and can be difficult to repair.

Finally, prior art stabilizing methods require the fletching to pass over and/or through the arrow rest causing possible interference with the rest, thus imposing certain design limitations. Arrow rests may interfere with the flight of an arrow through inadvertent contact therewith, thereby adversely affecting flight performance, as well as damaging the fletching through such contact. While fall-away or offset rests must often be used to reduce the incidence of contact between the arrow rest and the fletching of an arrow, such rests can be expensive and do not resolve other above-mentioned problems associated with fletching.

U.S. Pat. No. 5,951,419 to Cameneti addresses the above mentioned fletching inconsistency issue by teaching a single-piece fletching mounted on the rear portion of the shaft of the arrow, wherein the fletching comprises a flared cone projecting rearward and outward, giving the fletching a funnel-shaped appearance. Deficiencies of this solution, however, include a significantly increased drag problem, excessive length, and failure to resolve the interference problem.

SUMMARY OF THE INVENTION

The present invention provides a stabilizer, an arrow, and related archery tools incorporating a novel aerodynamic design for arrows having a variety of general or specialized uses. This improvement is achieved by elimination of conventional fixed tail feathers and the use of a stabilizer consistent with the present invention.

The improved stabilizer of the present invention may be used for an arrow or other projectile and resolves prior art issues related to clearances, fletching inconsistency, environmental sensitivity, field replaceability, and excessive drag. A stabilizer consistent with the present invention comprises a unit adapted to slide along the shaft of an arrow, which is mounted on the leading end of the arrow until the arrow is propelled from the bow, at which time the stabilizer travels to the trailing end of the arrow and is secured at a predetermined location along the shaft, as the arrow travels beyond the rest and bow. A stop adapted to prevent further rearward travel of the stabilizer during the flight of the arrow may be integral to the shaft or nock, or alternatively may be a separate unit adapted to mate with the shaft or nock of an arrow.

The present invention provides a field replaceable sliding stabilizer that eliminates the inconsistencies and costs associated with traditional multi-piece glue on fletching systems. Further, an arrow comprising a stabilizer consistent with the present invention eliminates interference at the arrow rest caused by conventional fletching and a conventional bow.

A stabilizer consistent with the present invention may easily be mass-produced and is capable of providing high accuracy devices with highly repetitive results in use. Such a stabilizer may comprise a plurality of projections or "fingers" that aid in the operation of the stabilizer by creating a friction or interference fit between the arrow shaft and the stabilizer during slideable engagement therebetween. A stabilizer consistent with the present invention may be particularly shaped or otherwise adapted to provide additional aerodynamic features, e.g., impact force on the target or other such flight characteristics. Further, two or more stabilizers may be disposed along the shaft of an arrow, e.g., at the forward tip to prevent instability caused by the use of exotic or poorly balanced arrows.

Further, the present invention provides an arrow having improved aerodynamic characteristics, resulting in increased flight stability, speed, and accuracy. An arrow consistent with the present invention requires no feathers or traditional fletching, instead utilizing a sliding aerodynamic stabilizer that is slid or mounted over the front or rear of the arrow shaft, and the arrow travels through the stabilizer until it is positioned on the arrow at a provided stop, after which the stabilizer flies the arrow in a conventional manner. Since an arrow consistent with the present invention may comprise a short cross section, flight stability is less impacted by cross wind drift and wobble. Further, since the arrow requires no fixed fletching attached thereto, the arrow may have a higher acceleration rate due to a reduced mass that has to be initially accelerated by the bow.

DETAILED DESCRIPTION OF EXEMPLARY EMBODIMENTS

Figure 1:
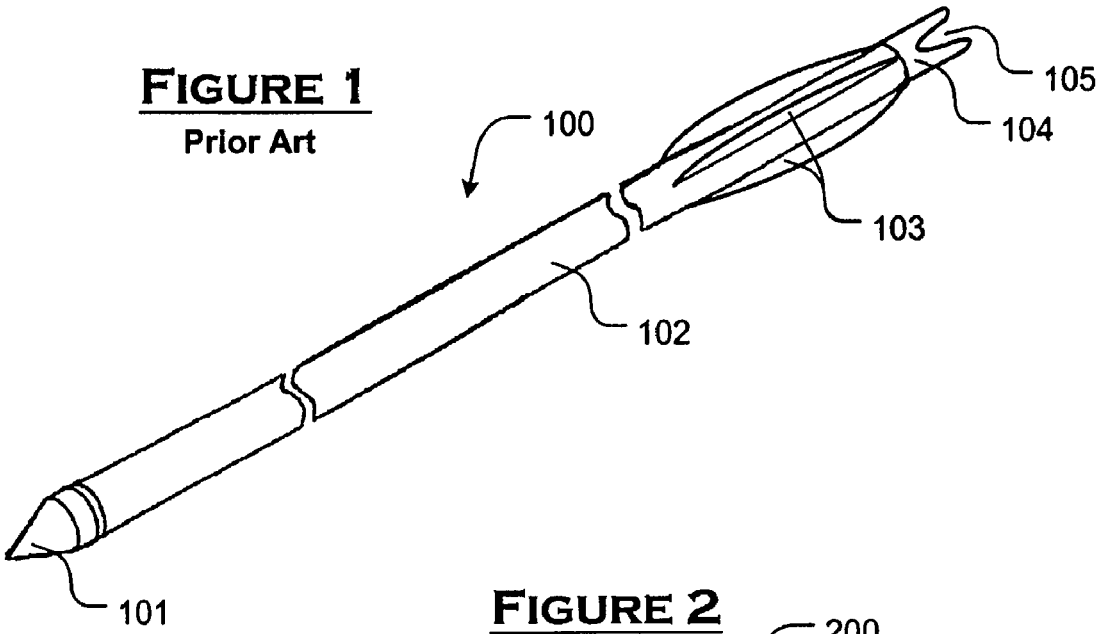
FIGURE 1 Prior Art
FIG. 1 is a perspective view of a conventional arrow shaft comprising prior art fin-type fletching.

As illustrated in FIG. 1, a conventional arrow 100 comprises a tip 101, a shaft 102, and a prior art stabilization system comprising a plurality of fins 103 as fletching. The fins 103 are fixed to the shaft 102, e.g., by gluing, and are easily damaged or lost through contact with other surfaces, e.g., with the bow used to launch the arrow 100, with butt material (backing, bales, or dirt designed to stop and hold arrows) of a paper target, or with a game animal. The trailing end of the arrow 100 may comprise a recess (not shown) formed therein for engagement (e.g., via a plurality of threads) with a nock 104 that secures the arrow 100 in place before launch, e.g., by disposing a bowstring (not shown) within a notched area 105 of the nock 104.

Figure 2:
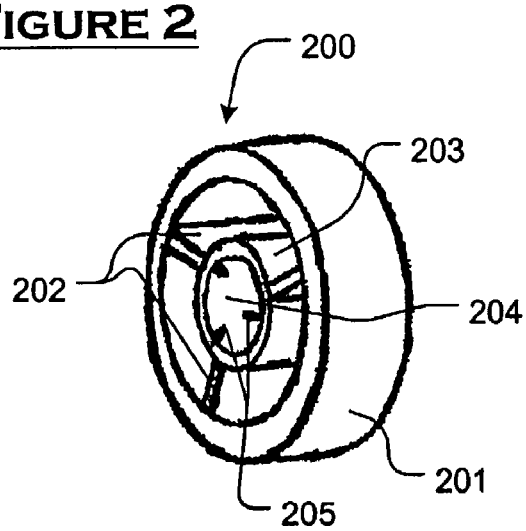
FIGS. 2, 2A and 2B are perspective views of exemplary stabilizers made in accordance with the present invention.

Turning now to FIG. 2, an exemplary arrow stabilizer 200 in one embodiment of the present invention is illustrated. This "sliding" stabilizer is field replaceable, reduces assembly labor cost, and significantly improves the stability of arrows. In the embodiment shown, the stabilizer 20 comprises an annular wing 201, a plurality of fins 202, a cylindrical mating aperture 204 formed within a central annular structure 203, and a plurality of projections 205 (or "fingers") formed within the mating aperture 204. In addition to providing stability, the annular wing 201 may further be adapted to add rigidity to and/or to direct air to the fins 202. The fins 202 have a dual function, serving both as aerodynamic elements and structural elements bridging the annular wing 201 and the central annular structure 203. The exemplary stabilizer 200 shown is designed to replace conventional fletching, i.e., to be used with an arrow having no other form of fletching (although it is contemplated that, in certain embodiments, a stabilizer consistent with the present invention might be used with an arrow having other fletching, such as fins). The cylindrical mating aperture 204 formed within the central annular structure 203 of the stabilizer 200 is sized to have a diameter larger than that of the shaft of an arrow, so that the arrow shaft can be slidably disposed therein. One or more projections 205 formed within the mating aperture 204 are adapted to secure the shaft of an arrow disposed within, such that the stabilizer 200 may be slidably captivated about the shaft, e.g., at the leading end of the arrow before it is launched.

Figure 3:
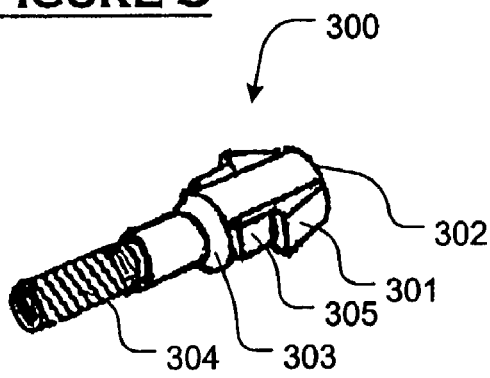
FIG. 3 is a perspective view of an exemplary stop in one embodiment of the present invention.

With reference to FIG. 3, an exemplary stop 300 is illustrated. The stop 300 may be disposed, e.g., at the trailing end of the shaft of an arrow, for captivating the stabilizer 200 during the flight of the arrow. In the embodiment shown, the stop 300 comprises a plurality of threads 304 for mating with a corresponding recess in the trailing end of the shaft of an arrow (not shown), at least one taper 303 (or barb, "ramp," or other projection) adapted to impede gradually the travel of a stabilizer 200, at least one projection 301 adapted to prevent the travel of a stabilizer 200 beyond the projections 301, and a captivating region 305 (in the embodiment shown, the captivating region 305 comprises two opposing non-tapered projections) disposed adjacent to the projections 301 where the stabilizer 200 can remain captive, and may further comprise a socket 302 adapted to receive a nock engaged (e.g., threadably) therewith. The taper 303 is sized to have a diameter that increases from a diameter smaller than that of the cylindrical mating aperture 204 to a diameter equal to or greater than that of the cylindrical mating aperture 204, and thereby gently slows the travel of the stabilizer as it passes through the cylindrical mating aperture 204 and provides a "soft" stop to captivate the stabilizer 200 during flight. In contrast, the projections 301 provide a "hard" stop beyond which the stabilizer 200 cannot travel, which feature may be significant at such time as the arrow impact is made with a target, as follows: The outermost portions of the projections 301 may be sized so as to have a diameter equal to or slightly smaller than that of the cylindrical mating aperture 204, such that upon impact, the projections 301 mate with the cylindrical mating aperture 204 to secure the stabilizer 200 onto the stop 300, and the stabilizer 200 can thus prevent the trailing end of the arrow from passing through the target (e.g., a game animal). It is noted that a captivating region 305 may therefore be provided, comprising one or more projections with outermost portions sized so as to have a diameter slightly smaller than the cylindrical mating aperture 204, to provide a region in which the stabilizer 200 can remain captive by friction or interference fit or other mechanical means. Alternatively, in a scenario in which it is desirable for the arrow to be able to pass through the target, the stop 300 and/or stabilizer 200 could comprise means for releasing the stabilizer 200 from the stop 300 (e.g., the stop 300 could be formed without any projections 301), such that the arrow can pass through the target and the stabilizer 200 and/or stop 300 drop to the ground after the arrow completes its travel through the cylindrical mating aperture 204 of the stabilizer 200.

Figure 4:
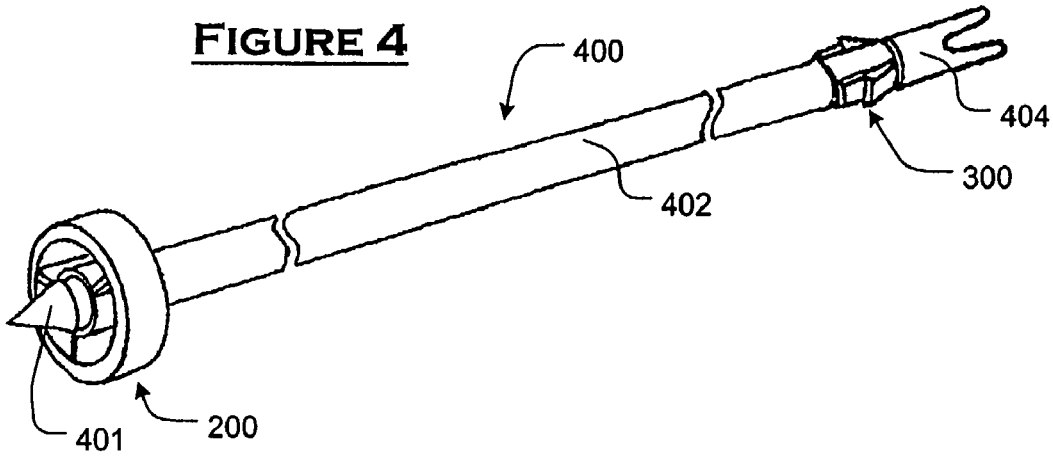
FIG. 4 is a perspective view of the exemplary stabilizer of FIG. 2 in one embodiment of the invention, positioned at the leading end of an arrow prior to the arrow being propelled from a bow.
Figure 5:
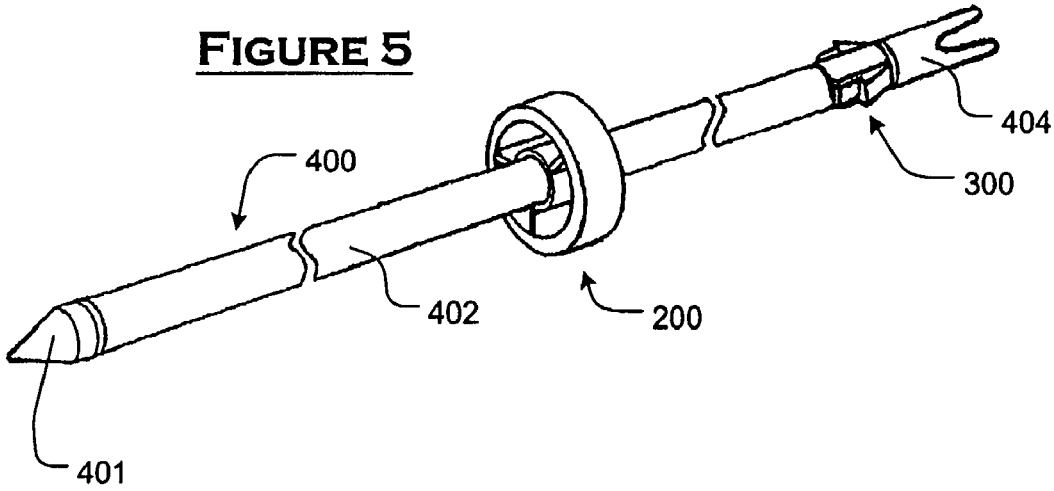
FIG. 5 is a perspective view of the exemplary stabilizer of FIG. 2 positioned along the shaft of the arrow in flight, shortly after the arrow is propelled, as the arrow travels forward through the stabilizer and the stabilizer travels toward the trailing end of the arrow.
Figure 6:
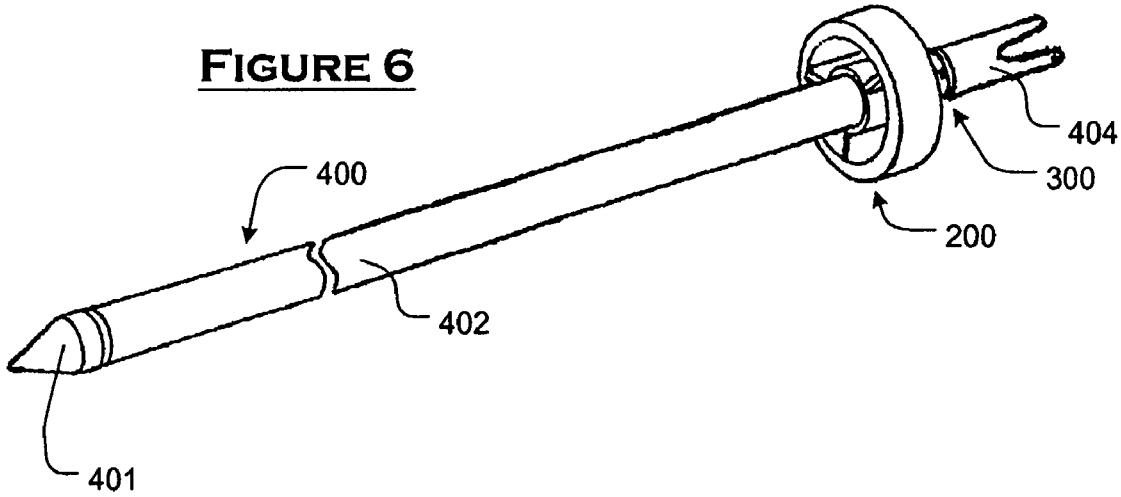
FIG. 6 is a perspective view of the exemplary stabilizer of FIG. 2 positioned at the trailing end of the arrow during the continued flight of the arrow, wherein the stabilizer is engaged with an exemplary stop disposed at the trailing end of the arrow.

FIGS. 4 through 6 illustrate the exemplary stabilizer 200 of FIG. 2 and the exemplary stop 300 of FIG. 3 in use during the flight of an exemplary arrow 400 having no fletching affixed to its shaft 402.

As shown in FIG. 4, prior to the arrow 400 being propelled from a bow (not shown), the stabilizer 200, which is adapted to slide along the shaft 402, is positioned around the shaft 402 at the leading end of the arrow 400, just beyond the tip 401. The arrow 400 is then drawn back prior to launch, and the stabilizer 200 remains loosely captivated at the front of the arrow shaft 402. The arrow 400 is then launched. As the arrow 400 begins to leave the bow after the string is released, the stabilizer 200 slides along the shaft 402 toward the trailing end of the arrow 400 as the arrow 400 travels through the cylindrical mating aperture 204 of the stabilizer 200. The travel of the stabilizer 200 occurs as a result of the substantially slower rate of acceleration of the stabilizer 200 with respect to that of the arrow 400, due to low friction with the arrow 400, the natural resistance of the stabilizer 200 to begin movement, and wind and/or air resistance.

FIG. 5 shows the stabilizer 200 positioned along the shaft 402 of the arrow 400 in flight, shortly after the arrow 400 is propelled, as the arrow 400 travels forward through the stabilizer 200 and the stabilizer 200 travels toward the trailing end of the arrow 400.

As FIG. 6 illustrates, the arrow 400 slides forward through the stabilizer 200 until contact is made with the stop 300, with which the stabilizer 200 engages, causing the stabilizer 200 to remain captive at the trailing end of the arrow 400 for the duration of the flight, thereby providing controlled stabilization, spin, and/or other flight characteristics, e.g., wobble or longitudinal compression of the arrow.

When the stabilizer is positioned at the leading end of the arrow prior to flight, the arrow may be launched in a conventional manner, except for the conventional nock position on the bowstring. In contrast, with conventional arrows, the nock must be positioned in a particular orientation or relationship to the fletching and string. An arrow equipped with a stabilizer consistent with the present invention needs no particular orientation or clocking, since there is no risk of the stabilizer interfering with the arrow rest or any other part of the bow.

The elimination of conventional fletching tail feathers from the body of arrows, as achieved by the present invention, allows for easy storage of arrows without causing damage to stabilizing surfaces. Typical fletched arrows are delicate and easily become damaged when stored or when used in the field. A stabilizer consistent with the present invention may simply be removed from the arrow and the bare arrow shaft stored without the possibility of fletching damage. Further, a damaged fletching unit may be replaced in the field in seconds, without any loss of accuracy or repeatability. Additionally, since the stabilizer is mechanically fixed to the arrow during flight and does not require gluing, the use of toxic glues and other chemicals can be reduced by way of the present invention.

Various changes may be made in the foregoing invention without departing from the spirit and scope thereof. For example, it is noted that the stop may be located so as to captivate the stabilizer at the trailing end of the arrow shaft, or alternatively, at another location along the shaft selected to optimize arrow flight for a given application, e.g., for balance, stability, or shootability of the arrow. When the stabilizer is disposed as closely as possible to the trailing end of the arrow, the center of the stabilizing force can be situated rearward beyond that of convention fletching and closer to the trailing end of the arrow shaft than possible with conventional fletching. Since the stabilizing force or equivalent center of pressure caused by the stabilizer of the present invention may be positioned rearward beyond that of conventional vanes, the force required to produce an equivalent stabilization force decreases, and thus, the total surface area required to produce an equivalent force is reduced. The arrow speed is increased over conventionally fletched arrows due to less frictional drag as a result of the reduced surface area required for stabilization. Further, the decrease in the cross sectional area of the stabilizing surface, as compared to conventional vanes, results in less cross wind drift and improved accuracy when shooting in cross winds.

With conventional bow and/or arrow rest designs, it is desirable for the stabilizer to be positioned over the leading end of the arrow shaft and positioned at a close distance from the leading end of the arrow prior to launch, so as not to obstruct the tip of arrow. It is, however, contemplated that the stabilizer may, alternatively, be fixed along the shaft at a given location, instead of being slidably disposed along the shaft. Such fixation may either be permanent (e.g., gluing) or temporary (e.g., engagement with a stop, as described hereinabove). An exemplary such application would be the use of the stabilizer consistent with the invention with a bow having offset arrow guides, narrow arrow rests, or fall-away rests, wherein the stabilizer can begin flight disposed at the trailing end of an arrow. Thus, the stabilizer of the present invention solves the interference issue for all bows in use, even specialized bows and arrow rests already adapted to minimize interference with fletching, and users of such specialized bows and arrow rests may enjoy the same benefits of the present invention as users of conventional bow rests.

Figure 9:
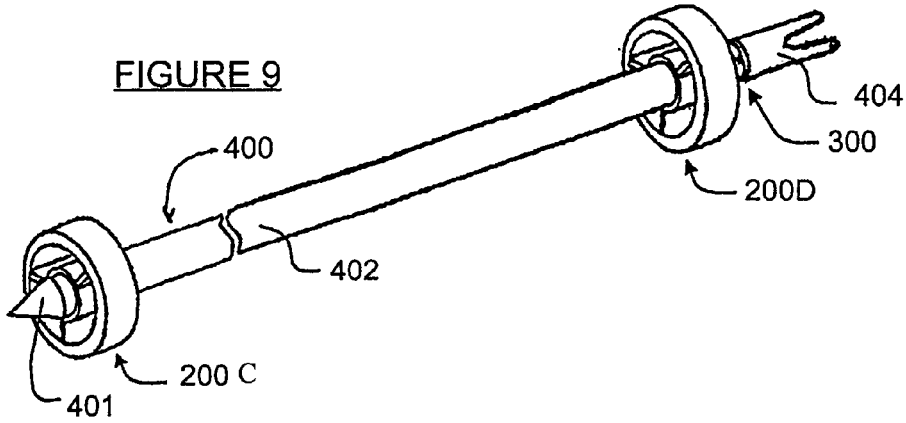
FIG. 9 is a view similar to FIG. 7 of another embodiment of the invention.

Additionally, as shown in FIG. 9 more than one stabilizers may be used for certain applications, e.g., a fixed stabilizer 200C at one location along the shaft, and a sliding stabilizer 200D elsewhere along the shaft.

Figure 8:
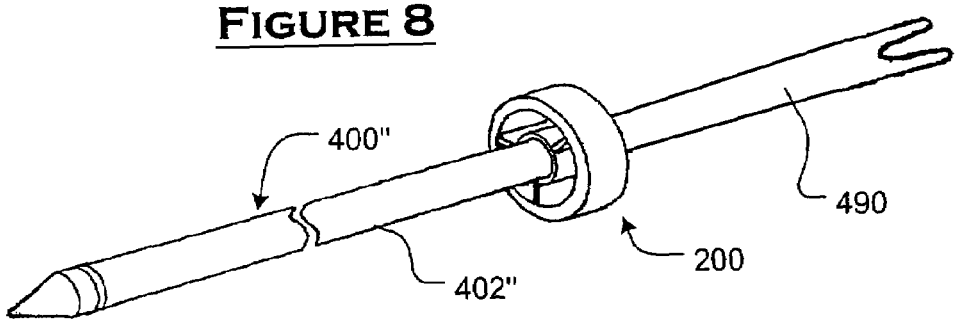
FIG. 8 is a perspective view of an exemplary stabilizer positioned along the shaft of an arrow in flight, wherein the arrow shaft has an increasingly larger diameter toward its trailing end.

It should be understood that a stop consistent with the separate component from the nock and/or shaft, or alternatively, may be integrated into either the nock, the shaft, or both. Since the trailing ends of many conventional arrow shafts are already adapted to receive a nock therein (e.g., via a threaded recess), it is contemplated that a threaded stop 300, e.g., as illustrated in FIG. 3, could be installed in its place. Thus, if the stop is constructed to have a similar adapter for receiving a nock therein (e.g., a threaded recess), a conventional nook could be removed from an arrow shaft and replaced by a stop, and then the nock could easily be installed directly into the stop. Of course, a stop consistent with the present invention could alternatively comprise a nock or similar device formed therein, and a nock consistent with the present invention could alternatively comprise a stop device. It should further be recognized that a stop mechanism could be integrated into an arrow shaft and may merely comprise a single taper, O-ring, or similar feature located along the shaft and appropriately sized to captivate the stabilizer. For example, as FIG. 8 illustrates, the stop mechanism may comprise an arrow 400" having a shaft 402" with a tapered portion 490 formed such that the shaft 402" has an increasingly larger diameter toward its trailing end, to captivate the stabilizer 200.

As those skilled in the art will recognize, while the exemplary stabilizer 200 illustrated and described hereinabove comprises a pair of nested annular structures, a stabilizer consistent with the present invention may comprise a variety of other shapes, sizes and configurations. For example, the annular wing might comprise a square, rectangular, ovular, or other cross section instead of a circular cross-section. Alternatively, instead of an annular wing, a plurality of arcuate or straight wing sections not connected to one another might serve as wings, wherein each section is held onto a central annular structure by means of one or more fins or other support members.

Figure 7:
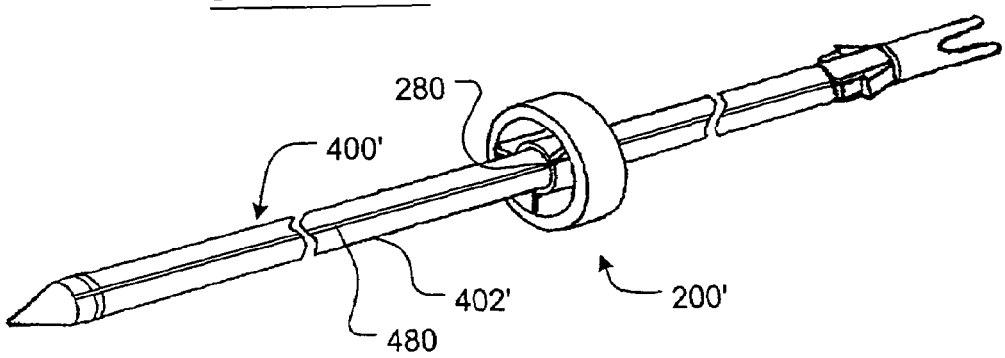
FIG. 7 is a perspective view of an exemplary stabilizer positioned along the shaft of an arrow in flight, wherein the arrow shaft has a groove or ridge formed therein or thereon, and wherein the stabilizer has a corresponding groove or ridge to mate with the groove or ridge of the arrow shaft.

The central annular structure of the stabilizer and the cylindrical mating aperture formed therein could alternatively comprise other configurations for mating with the shaft of an arrow, such as a plurality of arcuate sections or inward projections on the stabilizer appropriately sized for mating with the shaft. The mating of stabilizer and shaft could also be accomplished through a number of alternative means, e.g., as FIG. 7 illustrates, a groove or track configuration, wherein a groove or ridge 480 is formed in or on the shaft 402' of the arrow 400' along its length, and an element 280 (e.g., a groove, notch or projection) adapted to mate with and slide within or along the groove or ridge 480 projects from or is formed in the stabilizer 200'.

While three fins generally provide maximum stability without adding too much weight to the stabilizer and arrow, it should be recognized that the fins of the stabilizer can vary in number, shape, size, angular disposal, and other aspects, and certain embodiments of the stabilizer might not even include any fins. The angle(s) at which the fins are mounted may also vary, e.g., various embodiments may include fins angularly fixed relative to the longitudinal axis of the arrow to provide rotational spin force to the arrow; fins fixed parallel to the longitudinal axis of the arrow to prevent the spin of the arrow, e.g., to improve penetration of the arrow into the target; or alternatively, fins fixed parallel to the longitudinal axis of the arrow with an expanding taper design terminating at the trailing edge of the fin to produce rotational spin. Thus, a user can change the flight characteristics from a spinning arrow, which is similar to a bullet shot from a rifled barrel, to a non-spinning arrow, for better target penetration when using certain tips. It is further noted that the number, size and shape of stabilizing fins attached to the stabilizer may vary without interference concerns at the arrow rest or other portions of the bow. Cross-sections of the fins at certain locations thereon may have varying shapes, e.g., airfoil-shaped or tapering cross-sections, to effect various modifications in flight. The fins may be formed with one or more apertures therein, to reduce the weight of the stabilizer and/or for reasons of aerodynamics.

The projections or "fingers" of the stabilizer that create a friction or interference fit between the arrow shaft and the stabilizer during slideable engagement therebetween could alternatively comprise other configurations, e.g., a taper, or a single projection in the form of a flexible O-ring. Such projections, tapers, fingers, O-rings, or similar self-adjustment or self-centering features may further be adapted to permit a single stabilizer to be used with a variety of arrows having shafts of varying dimensions, tolerances, or other characteristics, e.g., by construction using a flexible material, such that the projections expand or contract to create a friction or interference fit with arrow shafts having varying diameters, or even shafts having cross-sections other than circular.

Materials for constructing a stabilizer and/or stop consistent with the present invention may include one or more metals, e.g., aluminum, or plastics such as nylon, polyethylene, or polypropylene. Such a stabilizer and/or stop may be manufactured as a one-piece unit or other multi-piece designs, and may be flexible, rigid, semi-rigid, or comprise components of differing materials or having differing rigidity. The stabilizer and/or stop may be made in a variety of varying lengths, colors, and configurations, and may be manufactured by a number of techniques, e.g., as injection molding. The stabilizer and/or stop may comprise luminescent, bio-luminescent, electro-luminescent, or photo-luminescent materials for ease of visibility and retrieval, particularly in dark or dull-colored environments.

Those skilled in the art will recognize that a stabilizer consistent with the present invention has utility not only in the field of archery, but may also have utility in improving the flight of other types of projectiles, e.g., a javelin or an atlatl (a device that is used to throw with considerable mechanical advantage a lightweight spear called a dart). It is further noted that a projectile used in conjunction with a stabilizer consistent with the present invention does not necessarily have to be one adapted for air travel, but instead could be a projectile for travel in water (e.g., for bowfishing or spearfishing), or another liquid or gaseous media.

It is further contemplated that various toolsets or kits may be provided, wherein the sets of tools comprise one or more of the following: one or more stabilizers, one or more stops, one or more nocks, one or more arrow shafts, and one or more arrows. For example, a toolset might comprise an arrow (or just a shaft) and a corresponding sliding stabilizer adapted for travel along the arrow and/or shaft; or a stabilizer and a corresponding stop; or an arrow (or just a shaft) and a stop adapted for engagement with the shaft. Further, a set of stabilizers having differing dimensions from one another may be provided (differing in, e.g., diameter of the annular wing, angular configuration of the fins, diameter of the central mating aperture, length of the projections formed in the central mating aperture), which may have utility, e.g., when using arrow shafts having differing diameters. Further, a set of stabilizers could comprise a plurality of differently colored stabilizers for ease of individual identification.

Figure 2A:
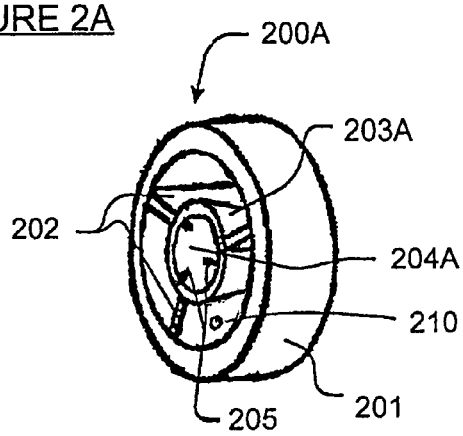
Figure 2B:
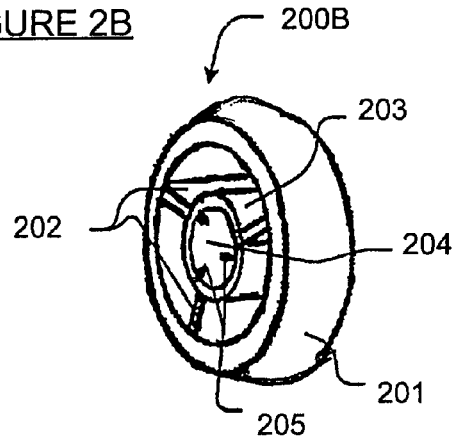

Although the present invention has been set forth in terms of the embodiments described herein, it is to be understood that such disclosure is purely illustrative and is not to be interpreted as limiting. Consequently, without departing from the spirit and scope of the invention, various alterations, modifications, andlor alternative applications of the invention will, no doubt, be suggested to those skilled in the art after having read the preceding disclosure. For example, as shown in FIG. 2A, the stabilizer annular cross-sections 203A may be tapered to have inner diameters 204A that narrow along their respective lennths of the stabilizer 200A. Also, if desired, one or more apertures 210 may be formed in the fins 202. And, as shown in FIG. 2B, the annular wing 200B need not be circular, but may be ovular, airfoil-shaped and or tapered in cross-section. Accordingly, it is intended that the following claims be interpreted as encompassing all alterations, modifications, or alternative applications as fall within the true spirit and scope of the invention.

We claim:

1. A stabilizer for a non-self-powered projectile, said stabilizer comprising:

an annular wing and a mating feature having an annular cross-section adapted to engage said stabilizer with a non-self-powered projectile, wherein the mating feature of said stabilizer comprises at least one projection adapted to cause a friction or interference fit with said projectile, said projection protruding in an inward direction with respect to said annular wing, and wherein at least a portion of said stabilizer comprises a luminescent, bio-luminescent, photo-luminescent, or electro-luminescent material.

2. A stabilizer as claimed in claim 1, wherein said at least one projection comprises an O-ring.

3. A stabilizer as claimed in claim 1, further comprising at least one fin.

4. A stabilizer as claimed in claim 3, wherein said fin is disposed substantially orthogonally with respect to said annular wing and/or within said annular wing.

5. A stabilizer as claimed in claim 3, wherein at least a portion of said fin comprises a substantially airfoil-shaped and/or tapered cross section.

6. A stabilizer as claimed in claim 3, wherein said fin bridges said annular wing and the mating feature of said stabilizer.

7. A stabilizer as claimed in claim 3, wherein said annular wing has a longitudinal axis, wherein said fin either is disposed at an angle with respect to said annular wing, said angle being selected to provide a predetermined amount of rotation about the central axis of said stabilizer when said stabilizer is engaged with a non-self-powered projectile; or is disposed substantially parallel to the longitudinal axis of said annular wing to prevent rotation about said longitudinal axis when said stabilizer is engaged with a non-self-powered projectile.

8. A stabilizer as claimed in claim 3, wherein said fin comprises at least one aperture formed therein and/or wherein said plurality of fins comprises three fins.

9. A stabilizer as claimed in claim 1, wherein said stabilizer has a plurality of said annular cross-sections having inner diameters that narrow along the length of said mating feature.

10. A stabilizer as claimed in claim 1, wherein at least a portion of said annular wing has a substantially circular, ovular, airfoil-shaped, and/or tapered cross-section.

11. A stabilizer for a non-self-powered projectile, said stabilizer comprising:

an annular wing and a mating feature adapted to engage said stabilizer with a non-self-powered projectile, wherein the mating feature has a diameter, and comprises at least one projection adapted to cause a friction or interference fit with said projectile, said projection protruding in an inward direction with respect to said annular wing;

wherein said at least one projection comprises a plurality of projections protruding in an inward direction with respect to said annular wing; and wherein the innermost points of each of said projections all lie along a circle having a smaller diameter than the inner diameter of the annular cross-section of the mating feature.

12. An arrow comprising:

a shaft having a leading end and a trailing end;

a stabilizer comprising an annular wing equi-spaced from and surrounding a central annular structure, said stabilizer slidably disposed on or fixed to said shaft via said central annular structure; and a tip disposed at the leading end of said shaft, said tip not being connected to said stabilizer.

13. An arrow as claimed in claim 12, wherein said stabilizer is removably disposed at the leading end of said shaft.

14. An arrow as claimed in claim 12, further comprising a second stabilizer comprising an annular wing.

15. An arrow as claimed in claim 12, wherein said stabilizer is disposed at a location along said shaft, said location being selected to affect the balance of said arrow.

16. An arrow as claimed in claim 12, wherein said stabilizer is held onto the shaft by friction or interference fit.

17. An arrow comprising:

a shaft having a leading end and a trailing end;

a first stabilizer comprising an annular wing equi-spaced from and surrounding a central annular structure, said stabilizer slidably disposed on or fixed to said shaft via said central annular structure; and a second stabilizer comprising an annular wing, wherein one said second stabilizer is attached fixedly to said arrow.

18. An arrow comprising:

a shaft having a leading end and a trailing end; and a stabilizer comprising an annular wing, said stabilizer slidably disposed on or fixed to said shaft, wherein said shaft has at least one groove or ridge formed therein, and wherein said stabilizer comprises a feature slidably mountable within said groove or on said ridge.

19. An arrow comprising:

a shaft having a leading end and a trailing end; and a stabilizer comprising an annular wing, said stabilizer slidably disposed on said shaft;

wherein said stabilizer is adapted to travel along the length of said arrow in a direction from the leading end to the trailing end of said arrow while said arrow is in flight.

20. An arrow as claimed in claim 19, wherein said arrow is further adapted to stop said stabilizer at approximately the trailing end of said arrow while said arrow is in flight.

21. A shaft for an arrow, said shaft comprising:

an elongated member having a leading and a trailing end; and a stop adapted to engage a stabilizer disposed on said shaft, wherein said shaft has a trailing end, and wherein said stop is adapted for threadable engagement with the trailing end of said shaft.

22. A shaft for an arrow, said shaft comprising:

an elongated member having a leading and a trailing end; and a stop adapted to engage a stabilizer disposed on said shaft, wherein said stop has a trailing end and further comprises a recess at said trailing end, said recess being adapted to serve as a nock and/or being adapted to receive a separate nock component therein.

23. An arrow comprising:

a shaft having a leading and a trailing end; and means for engagement with a stabilizer disposed on said shaft;

wherein said engagement means is adapted for threadable engagement with the trailing end of said shaft.

24. An arrow comprising:

a shaft having a leading and a trailing end; and means for engagement with a stabilizer disposed on said shaft;

wherein said means for engagement has a trailing end and further comprises a recess at said trailing end, said recess being adapted to serve as a nock and/or being adapted to receive a separate nock component therein.

25. A stop device for engagement with a stabilizer for an arrow, said stop device having a leading end and trailing end and comprising a mating feature sized and shaped to engage with a stabilizer on the shaft of an arrow and a plurality of threads;

wherein said stop device is fixedly or removably attached to the shaft of an arrow, and wherein said stop device is adapted for threadable engagement with the shaft of an arrow or with a nock via said plurality of threads.

26. A stop device for engagement with a stabilizer for an arrow, said stop device having a leading end and trailing end and comprising a mating feature sized and shaped to engage with a stabilizer on the shaft of an arrow;

wherein said stop device is fixedly or removably attached to the shaft of an arrow; and wherein said stop has a trailing end and further comprises a recess at said trailing end, said recess being adapted to serve as a nock and/or being adapted to receive a separate nock component therein.

27. A nock for an arrow, said nock comprising a stop device for engagement with a stabilizer for a non-self-powered projectile, wherein said nock comprises a plurality of threads, and is adapted for threadable engagement with the trailing end of the shaft of said arrow via said plurality of threads, whereupon said nock is fixedly or removably attached to the shaft of an arrow.

28. A nock as claimed in claim 27, wherein said stop device is integral to and comprises a tapered region of said nock and/or comprises at least one protrusion adapted to prevent travel of said stabilizer beyond said protrusion and/or is adapted to engage said stabilizer by friction or interference fit.

29. A nock as claimed in claim 27, wherein said nock has a trailing end and further comprises a recess at said trailing end.

30. A set of archery tools comprising:

an arrow having a longitudinal axis; and a stabilizer comprising an annular wing equi-spaced from and surrounding a central annular structure, said stabilizer slidably mountable on said arrow via said central annular structure and adapted for travel along the longitudinal axis of said arrow.

31. A set of archery tools comprising:

an arrow having a longitudinal axis;

a stabilizer comprising an annular wing, said stabilizer slidably mountable on said arrow and adapted for travel along the longitudinal axis of said arrow; and a stop for preventing travel of said sliding component beyond a predetermined location along said arrow.

32. A set of archery tools comprising:

a shaft for an arrow;

a sliding component slidably mountable on said shaft and adapted for travel along the longitudinal axis of said shaft, said sliding component comprising an annular wing; and a nock component adapted for engagement with said shaft.

33. A set of archery tools comprising:

a stabilizer comprising an annular wing and having a central portion; and a stop adapted for slidable disposition through said central portion of said stabilizer and for engagement with said stabilizer at a predetermined location along the shaft of an arrow.

34. A set of stabilizers for a non-self-powered projectile comprising:

a plurality of stabilizers, each said stabilizer comprising an annular wing and having a central portion, and being adapted for slidable disposition along the shaft of a non-self-powered projectile via said central portion, wherein at least two said stabilizers have at least one differing dimension from one another;

wherein said differing dimension is the diameter of said annular wing; and/or wherein each said stabilizer has a mating feature having an annular cross-section having an inner diameter, said mating feature adapted to engage said stabilizer with a non-self-powered projectile having a corresponding mating feature, and said differing dimension is the inner diameter of the annular cross-section of said mating feature; and/or wherein each said stabilizer comprises a mating feature comprising at least one projection adapted to cause a friction or interference fit with a non-self-powered projectile, said projection protruding in an inward direction with respect to said annular wing and having a protrusion length, and said differing dimension is the protrusion length of said projection.

35. A stabilizer for a non-self-powered projectile, said stabilizer comprising:

an annular wing and a mating feature having an annular cross-section adapted to engage said stabilizer with a non-self-powered projectile, wherein said stabilizer has a plurality of said annular cross-sections having inner diameters that narrow along the length of said mating feature.

36. A stabilizer for a non-self-powered projectile, said stabilizer comprising:

an annular wing and a mating feature having an annular cross-section adapted to engage said stabilizer with a non-self-powered projectile, wherein said annular wing has a longitudinal axis, wherein said mating feature either is disposed at an angle with respect to said annular wing, said angle being selected to provide a predetermined amount of rotation about the central axis of said stabilizer when said stabilizer is engaged with a non-self-powered projectile; or is disposed substantially parallel to the longitudinal axis of said annular wing to prevent rotation about said longitudinal axis when said stabilizer is engaged with a non-self-powered projectile.

37. A stabilizer for a non-self-powered projectile, said stabilizer comprising:

an annular wing and a mating feature having an annular cross-section adapted to engage said stabilizer with a non-self-powered projectile, wherein at least a portion of said stabilizer comprises a luminescent, bio-luminescent, photo-luminescent, or electro-luminescent material.

38. A stabilizer as claimed in claim 37, further comprising at least one fin.

39. A stabilizer as claimed in claim 38, wherein said fin is disposed substantially orthogonally with respect to said annular wing and/or within said annular wing.

40. A stabilizer as claimed in claim 38, wherein at least a portion of said fin comprises a substantially airfoil-shaped and/or tapered cross-section.

41. A stabilizer as claimed in claim 38, wherein said fin bridges said annular wing and the mating feature of said stabilizer.

42. A stabilizer as claimed in claim 38, wherein said stabilizer has a plurality of said annular cross-sections having inner diameters that narrow along the length of said mating feature.

* * * * *

UNITED STATES PATENT AND TRADEMARK OFFICE

CERTIFICATE OF CORRECTION

PATENT NO. : 7,331,886 B2
APPLICATION NO. : 10/227002
DATED : February 19, 2008
INVENTOR(S) : Morris et al.

It is certified that error appears in the above-identified patent and that said Letters Patent is hereby corrected as shown below:

Claim 11, Col. 9, line 36, "has a diameter" should be --an annular cross-section having an inner diameter--.

Signed and Sealed this

Sixteenth Day of December, 2008

JON W. DUDAS
*Director of the United States Patent and Trademark Office*